US009793021B2

(12) United States Patent
Carver et al.

(10) Patent No.: US 9,793,021 B2
(45) Date of Patent: Oct. 17, 2017

(54) TRANSFER CASK SYSTEM HAVING PASSIVE COOLING

(71) Applicant: NAC International, Inc., Norcross, GA (US)

(72) Inventors: George C. Carver, Norcross, GA (US); Vadim Z. Shtylman, Alpharetta, GA (US); Michael Yaksh, Lilburn, GA (US); Holger Pfeifer, Norcross, GA (US)

(73) Assignee: NAC INTERNATIONAL INC., Norcross, GA (US)

( * ) Notice: Subject to any disclaimer, the term of this patent is extended or adjusted under 35 U.S.C. 154(b) by 947 days.

(21) Appl. No.: 14/160,833

(22) Filed: Jan. 22, 2014

(65) Prior Publication Data

US 2015/0206610 A1 Jul. 23, 2015

(51) Int. Cl.
*G21F 5/10* (2006.01)
*G21F 5/008* (2006.01)

(52) U.S. Cl.
CPC ..... *G21F 5/10* (2013.01); *G21F 5/008* (2013.01)

(58) Field of Classification Search
CPC ..... G21F 5/10; G21F 5/008
USPC ..... 376/272
See application file for complete search history.

(56) References Cited

U.S. PATENT DOCUMENTS 3,111,586 A 11/1963 Rogers
3,113,215 A 12/1963 Allen
3,132,998 A 5/1964 Long et al.
3,296,084 A 1/1967 Fawcett et al.
3,781,189 A 12/1973 Kasberg
3,845,315 A * 10/1974 Blum ..... G21F 5/10 376/272

(Continued)

FOREIGN PATENT DOCUMENTS

EP 0757361 A1 2/1997
EP 0821367 A1 1/1998

OTHER PUBLICATIONS

Extended European Search Report in related European Application No. 10817736.1, mailed May 26, 2014.

(Continued)

*Primary Examiner* — Jack W Keith
*Assistant Examiner* — Daniel Wasil
(74) *Attorney, Agent, or Firm* — Thomas I Horstemeyer, LLP

(57) ABSTRACT

A transfer cask system for cooling spent nuclear fuel during the transfer from a spent nuclear fuel pool to a storage or transfer cask is disclosed. A canister containing spent nuclear fuel is inserted into a transfer cask. The transfer cask includes spacing components which define an annular region between the transfer cask and the canister. The transfer cask includes air inlets near a bottom end that permit air to flow through the defined annular region and exit at the open top of the transfer cask, thereby cooling the fuel within the canister. The transfer cask further comprises a neutron shield configured to absorb additional heat and shield radiation that may be generated within the canister. The transfer cask includes a transfer door that can open and close and has support rails that can support a spent nuclear fuel canister located in the transfer cask.

20 Claims, 8 Drawing Sheets

(56) References Cited

U.S. PATENT DOCUMENTS

| | | | | |
|---|---|---|---|---|
| 3,851,179 | A * | 11/1974 | Irvine | G21F 5/10 376/272 |
| 3,888,794 | A | 6/1975 | Kasberg | |
| 3,888,795 | A | 6/1975 | Kasberg | |
| 4,291,536 | A | 9/1981 | Girard | |
| 4,326,130 | A | 4/1982 | Ahner et al. | |
| 4,339,411 | A | 7/1982 | Knackstedt et al. | |
| 4,368,268 | A | 1/1983 | Gong | |
| 4,388,268 | A | 6/1983 | Knackstedt et al. | |
| 4,434,373 | A | 2/1984 | Christ et al. | |
| 4,521,691 | A | 6/1985 | Christ et al. | |
| 4,535,250 | A | 8/1985 | Fields | |
| 4,590,383 | A | 5/1986 | Machado et al. | |
| 4,666,659 | A * | 5/1987 | Lusk | G21F 5/008 376/272 |
| 4,752,437 | A | 6/1988 | Ito et al. | |
| 4,783,309 | A | 11/1988 | Popp et al. | |
| 5,058,655 | A | 10/1991 | Derp et al. | |
| 5,291,532 | A | 3/1994 | Townsend et al. | |
| 5,641,970 | A | 6/1997 | Taniuchi et al. | |
| 5,644,608 | A | 7/1997 | Malik et al. | |
| 5,668,843 | A | 9/1997 | Wasinger | |
| 5,887,042 | A | 3/1999 | Akamatsu et al. | |
| 6,195,404 | B1 | 2/2001 | Lemogne et al. | |
| 6,389,093 | B1 | 5/2002 | Gluschke et al. | |
| 6,498,826 | B2 | 12/2002 | Gluschke et al. | |
| 6,696,695 | B1 * | 2/2004 | Georgii | G21F 5/10 376/272 |
| 6,839,395 | B2 | 1/2005 | Ohsono et al. | |
| 7,215,728 | B2 | 5/2007 | Ohsono et al. | |
| 7,342,989 | B2 | 3/2008 | Pennington et al. | |
| 8,415,521 | B2 * | 4/2013 | Singh | G21F 5/005 588/16 |
| 2001/0015989 | A1 | 8/2001 | Gluschke et al. | |
| 2002/0152841 | A1 | 10/2002 | Ohsono et al. | |
| 2005/0117687 | A1 | 6/2005 | Carver et al. | |
| 2006/0188054 | A1 | 8/2006 | Pennington | |
| 2008/0137794 | A1 | 6/2008 | Tjersland et al. | |
| 2009/0175404 | A1 | 7/2009 | Singh et al. | |
| 2012/0037632 | A1 * | 2/2012 | Singh | G21F 5/005 220/367.1 |
| 2012/0201340 | A1 | 8/2012 | Pennington et al. | |
| 2015/0071398 | A1 * | 3/2015 | Singh | G21F 5/005 376/272 |

OTHER PUBLICATIONS

International Search report in related PCT Application No. PCT/US2010/048878, mailed Nov. 2, 2010.

Merriam-Webster's Collegiate Dictionary, 10th Edition, p. 748.

* cited by examiner

TRANSFER CASK SYSTEM HAVING PASSIVE COOLING

BACKGROUND

Spent nuclear fuel can be stored in reservoirs of water referred to as a spent nuclear fuel pool. Spent nuclear fuel assemblies can be immersed or stored in the spent nuclear fuel pool until such time as appropriate thermal and/or radioactivity conditions have been met, at which the assemblies can be transferred into transport and/or dry storage systems for off-site storage. As a spent nuclear fuel pool reaches capacity, it can be desirable to remove spent nuclear fuel assemblies and transfer one or more assemblies to on-site or off-site storage. On-site or off-site storage of spent nuclear fuel can involve transferring the spent nuclear fuel assemblies using a transfer cask to a storage cask and/or transport cask that is hardened against accidents that may occur during storage or transport.

SUMMARY

Included are systems and methods for cooling spent nuclear fuel during the transfer from wet to dry storage. One embodiment of a system, among others, includes a transfer cask system that implements passive cooling, comprising a first cylindrical container having a first side wall, a first top, and a first bottom that define a first interior that contains spent nuclear fuel; and a second cylindrical container having a second side wall, a second top, and a second bottom that define a second interior that contains the first cylindrical container, the second side wall being spaced from the first side wall to define an annular air passage, the second side wall having air inlets near the second bottom and an opening at the second top that permit air to flow from the air inlets, through the annular air passage, and to the opening to thereby remove heat by convection from the first cylindrical container.

Another embodiment of a system, among others, includes a transfer cask system that implements passive cooling, comprising a first elongated cylindrical container having a first annular side wall, a first top, and a first bottom that define a first interior that contains spent nuclear fuel; a second elongated cylindrical container having a second annular side wall, a second top, and a second bottom that define a second interior that contains the first cylindrical container, the second annular side wall being spaced from the first annular side wall to define an elongated cylindrical annular air passage, the second annular side wall having air inlets near the second bottom and an air outlet near the second top that permit air to flow from the air inlets, through the annular air passage, and to the air outlet to thereby remove heat by convection from the first elongated cylindrical container; and an annular neutron shield associated with the second annular side wall, the shield designed to absorb heat produced by the first elongated cylindrical container.

Also included is at least one embodiment of a method for passively cooling spent nuclear fuel during transfer from wet storage to dry storage, the method comprising receiving air at air inlets near a bottom end of a transfer cask; guiding the air, via the air inlets, to an annular air passageway defined by spacing components protruding from an interior side wall of the transfer cask, the interior side wall, and an exterior side wall of a container disposed within an interior of the transfer cask, the container containing spent nuclear fuel; transferring heat emitted from the container by convection to the air within the annular air passageway; and dispersing the air from an opening at a top end of the transfer cask.

Other embodiments, systems, methods, features, and advantages of this disclosure will be or become apparent to one with skill in the art upon examination of the following drawings and detailed description. It is intended that all such additional systems, methods, features, and advantages be included within this description and be within the scope of the present disclosure.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the disclosure. Moreover, in the drawings, like reference numerals designate corresponding parts throughout the several views.

DETAILED DESCRIPTION

Figure 1:
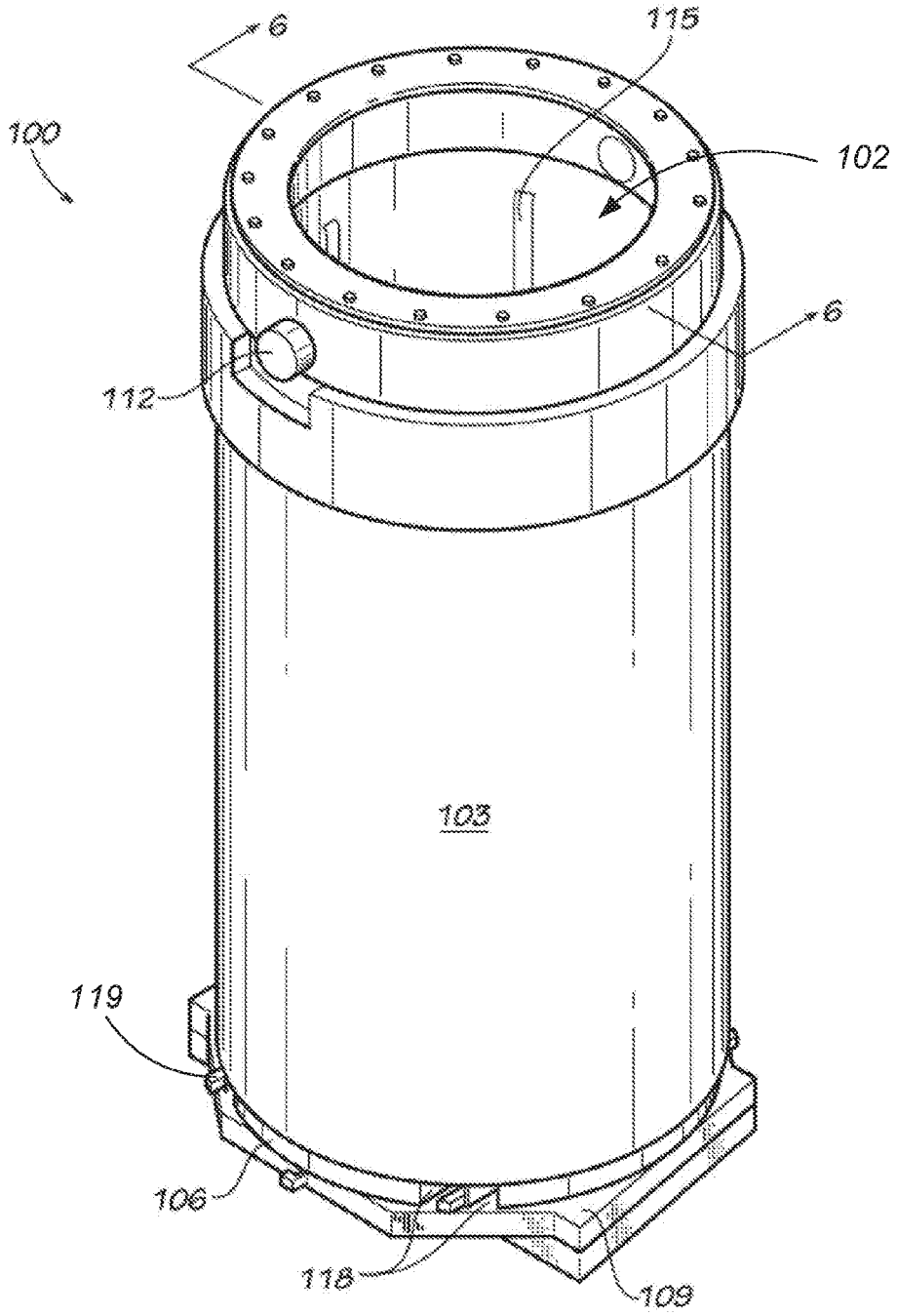
FIG. 1 is a drawing of an example of a transfer cask according to various embodiments of the present disclosure.

In the following discussion, a general description of systems and methods according to various embodiments of the present disclosure is provided, followed by a discussion of the operation of the same. Embodiments of the present disclosure relate to spent nuclear fuel transfer systems used to transfer spent nuclear fuel from wet storage to dry storage. More specifically, disclosed herein are novel approaches to the implementation of transfer casks that can increase the efficiency of removal and transfer of spent nuclear fuel from such a pool to an appropriate dry storage system.

When an operating reactor is shut down for refueling, spent nuclear fuel is stored in a spent nuclear fuel pool to allow for the thermal and radioactivity levels of the spent nuclear fuel to decrease. As a spent nuclear fuel pool reaches capacity, the spent nuclear fuel stored in the spent nuclear fuel pool that have reached the appropriate thermal and/or radioactive levels for removal can be removed from the pool and transferred to a dry storage system so that additional spent nuclear fuel assemblies that are used by a reactor can be immersed in the spent nuclear fuel pool. The spent nuclear fuel may be assembled and stored in spent nuclear fuel assemblies, for example, but not limited to, the spent nuclear fuel assemblies provided in U.S. patent application Ser. No. 13/395,712, filed on Sep. 15, 2010 and entitled "System and Method for Integration of Wet and Dry Nuclear Fuel Storage," which is hereby incorporated by reference in its entirety.

A dry storage system may include concrete storage casks in which properly conditioned and sealed metal canisters that include the spent nuclear fuel are inserted. A storage cask or transport cask serves as an enclosure or overpack structure that provides mechanical protection, heat removal features, and radiation shielding for the inner metal canister that encloses the spent nuclear fuel. In most dry storage systems used with wet storage (e.g. immersion in a spent nuclear fuel pool), the spent nuclear fuel at the time of discharge from a reactor emanates high levels of heat and radiation due to radioactive decay, levels that are higher than dry storage systems can efficiently and economically store. Therefore, discharged spent nuclear fuel must spend some amount of time in the spent nuclear fuel pool until the radioactive decay and associated heat has reached levels sufficiently low enough so that dry storage technology can be used. This period of time for required storage in the spent nuclear fuel pool can be 3 to 10 years or more.

When spent nuclear fuel is suitable for dry storage, a transfer cask may be employed to transfer the spent nuclear fuel from the nuclear fuel pool to the transport and/or storage cask associated with a dry storage system. During the transfer process, the transfer cask may be submerged in a transfer area of the nuclear fuel pool. The transfer cask is configured to accept a spent nuclear fuel canister having the spent nuclear fuel disposed therein. The transfer cask may be lifted from the nuclear fuel pool to allow for proper conditioning of the canister for dry storage. For example, final closure lids of the canister may be welded closed or sealed with mechanical methods at the power plants. Once the spent nuclear fuel canister is properly conditioned and sealed, the transfer cask may be used to transfer the canister to a transport and/or storage cask associated with a dry storage system.

Although the thermal and radioactive levels of the spent nuclear fuel may be sufficiently low enough to employ dry storage technology, the levels may increase without proper cooling and shielding features during the transfer process since the spent nuclear fuel canister is no longer in the spent nuclear fuel pool. To avoid an increase of thermal and/or radioactive levels during the removal of the spent nuclear fuel from the spent nuclear fuel pool, the spent nuclear fuel is required to be cooled and shielded.

Accordingly, embodiments of the present disclosure are directed to spent nuclear fuel transfer systems and methods that provide a more efficient transfer of spent nuclear fuel from wet storage to dry storage. In some embodiments, the transfer cask may be employed with air vents to allow for passive cooling during the conditioning and transfer process, thereby avoiding an increase of thermal temperature making the nuclear fuel no longer suitable for dry storage. Further, in some embodiments, the transfer cask may be designed with neutron shielding configured to shield radiation emitted from the spent nuclear fuel, thereby avoiding an increased risk of radiation exposure and/or accident during the conditioning and transfer process. The neutron shielding may be a liquid neutron shield or a solid neutron shield. In some embodiments, the transfer cask may be employed with a liquid shielding that not only is used to shield the radiation generated from the spent nuclear fuel, but also used to passively cool the canister by serving as a conductor, thereby allowing the heat to escape radially.

Figure 7:
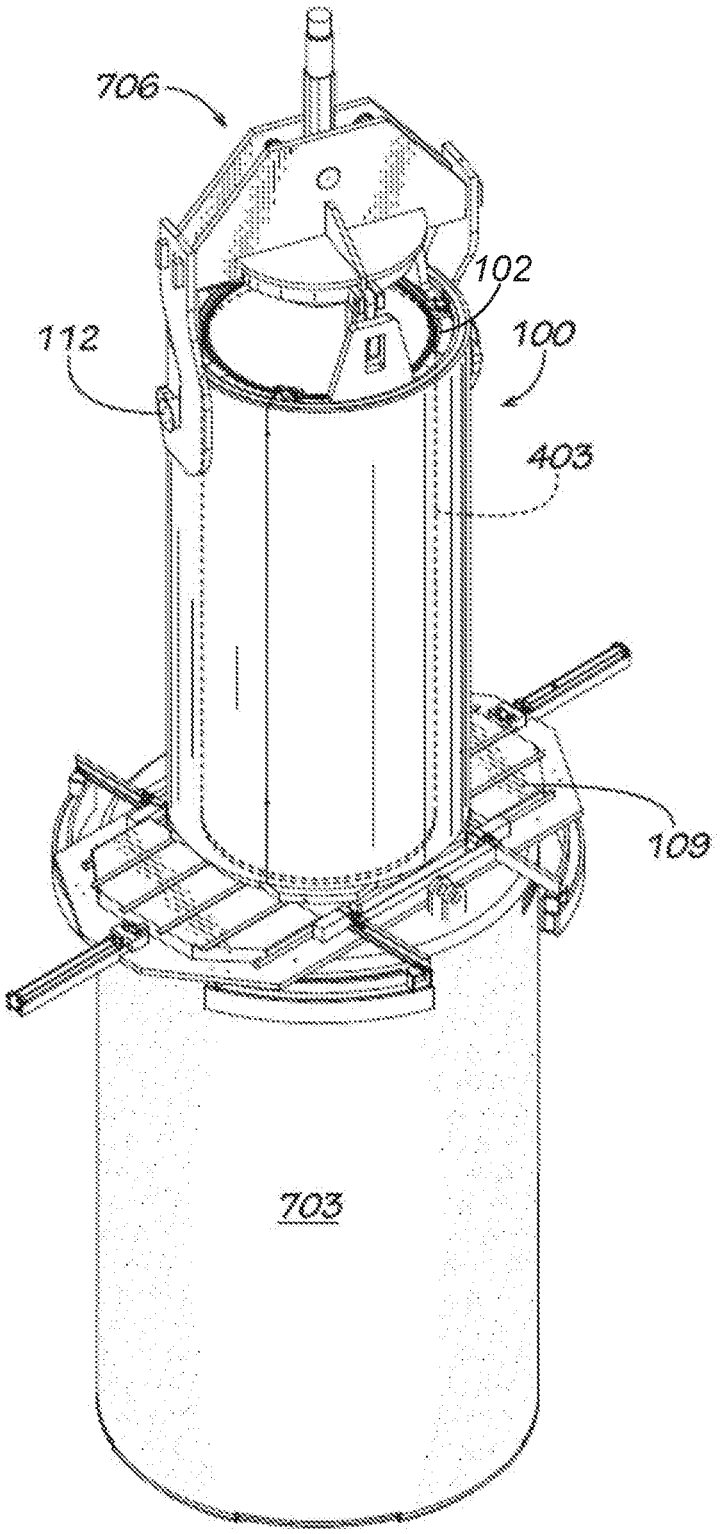
FIG. 7 is a drawing of an example of the transfer cask containing the spent nuclear fuel canister of FIG. 4 positioned over a storage or transport cask for transfer of the canister according to various embodiments of the present disclosure.

Referring now to FIG. 1, shown is a drawing of an example of a transfer cask 100 according to various embodiments. The transfer cask 100 shown in FIG. 1 includes a cylindrical transfer cask body 103. It should be understood that there may be other cross-sectional shapes for the transfer cask body 103 such as, for example, square, rectangular, octagonal, triangular body, etc., as well as a variety of lengths. The transfer cask body 103 comprises a side wall that defines an interior channel that extends from a top end of the transfer cask body 103 to a bottom end of the transfer cask body 103. The top end of the transfer cask 100 includes an opening 102 to the channel. Accordingly, the transfer cask 100 may receive the spent nuclear fuel for transfer via the opening of the top end of the transfer cask 100. The transfer cask 100 further includes an inlet ring 106, a transfer door 109, one or more lifting components 112 and one or more spacing components 115. The inlet ring 106 is adjacent to the bottom end of the transfer cask body 103. As will be discussed in greater detail in reference to FIG. 3, the inlet ring 106 provides one or more air inlets 118 for naturally receiving air that will be guided into the interior of the transfer cask 100. A transfer door 109 is disposed at the bottom end of the transfer cask 100 adjacent to the inlet ring 106 such that the inlet ring 106 is situated between the transfer door 109 and the bottom end of the transfer cask body 103. When closed, the transfer door 109 provides a seal at the bottom end of the transfer cask 100. The transfer door 109 may comprise one or more doors and is configured to be opened and closed. In a non-limiting example, the transfer door 109 may be closed to receive and support the spent nuclear fuel from the wet storage into the transfer cask 100. In another non-limiting example, the transfer door 109 may be opened when transferring the spent nuclear fuel from the transfer cask 100 to the transport or storage cask 703 (FIG. 7). The transfer door 109 comprises one or more support rails 119 that are designed to engage with positioning slots 303 (FIG. 3) of the inlet ring 106. The support rails 119 further support the bottom end of the spent nuclear fuel canister 403 (FIG. 4) when disposed within the transfer cask 100. In some embodiments, the transfer door 109 may comprise a neutron shielding configured to shield any radiation emitted from the spent nuclear fuel, thereby avoiding an increased risk of radiation exposure and/or accident during the conditioning and transfer process.

The lifting components 112 may be situated along the exterior of the transfer cask 100. The lifting components 112 are designed such that a lifting device 706 (FIG. 7), such as, for example, a crane, may connect to the lifting components 112 and support the transfer cask 100 during the transfer process. For example, the lifting device 706 may be used to submerge the transfer cask 100 into a transfer area in the pool for receiving the spent nuclear fuel, lift the transfer cask 100 out of the pool for conditioning, and position the transfer cask 100 over the transport or storage cask 703 for placement of the spent nuclear fuel into the transport or storage cask 703.

The spacing components 115 are attached to the interior side wall of the transfer cask body 103. The spacing components 115 may extend from about a top end of the transfer cask body 103 to about the bottom end of the transfer cask body 103. There may be one or more spacing components 115 attached to the interior side wall of the transfer cask body 103. The spacing components 115 are designed to protrude from the interior side wall of the transfer cask 100 such that annular regions extending from the bottom end of the transfer cask 100 to the top end of the transfer cask 100 are formed when a spent nuclear fuel canister 403 (FIG. 4) is placed within the transfer cask 100. As such, air received at the air inlets 118 of the inlet ring 106 may be guided into the annular regions defined by the spacing components 115, the interior side wall of the transfer cask 100, and the exterior side wall of the spent nuclear fuel canister 403. The annular regions enable convective heat flow for the dissipation of thermal energy, thereby passively cooling the spent nuclear fuel.

Figure 2:
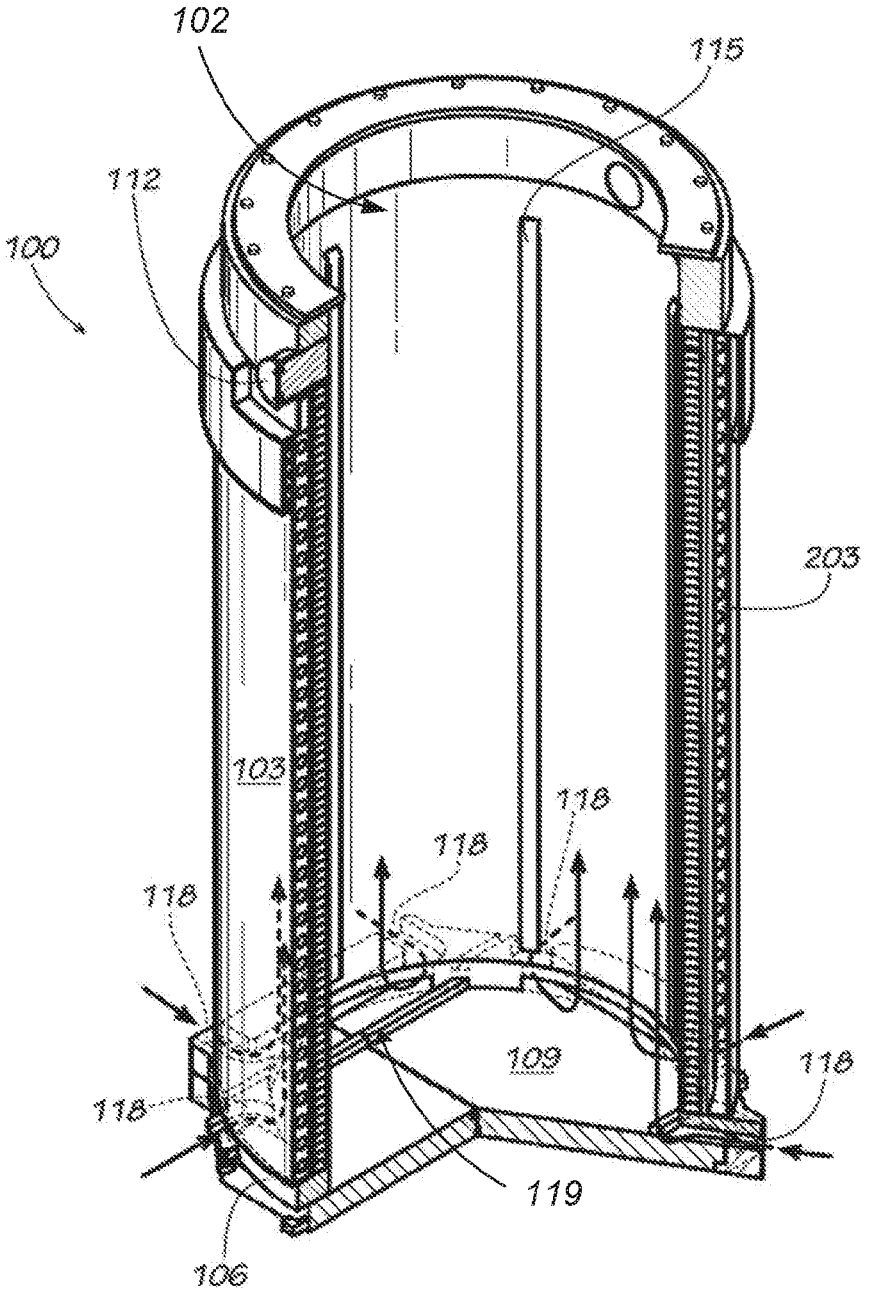
FIG. 2 is a drawing of an example of a cross-sectional view of the transfer cask of FIG. 1 according to various embodiments of the present disclosure.

Moving on to FIG. 2, shown is a drawing of a non-limiting example of a cross-sectional view of the transfer cask 100 of FIG. 1 according to various embodiments. The transfer cask 100 includes the transfer cask body 103 including an interior side wall and an exterior side wall. As shown, the top end of the transfer cask 100 is open to the interior channel defined by the interior side wall of the transfer cask body 103. The interior side wall of the transfer cask body 103 includes spacing components 115 protruding from the interior side wall and extending from about the bottom end of the transfer cask body 103 to about the top end of the transfer cask body 103. In addition, shown are the air inlets 118 within the inlet ring 106 that is positioned adjacent to the bottom end of the transfer cask body 103. As illustrated by the directional arrows shown in FIG. 2, air may enter via the air inlets 118 at the exterior side surface of the inlet ring 106 and exit the interior side surface of the inlet ring 106 and, thus, into the interior of the transfer cask 100.

The transfer cask 100 may also comprise a neutron shield 203 for shielding radiation emitted from spent nuclear fuel during the transfer from wet storage to dry storage via the transfer cask 100. A neutron shield 203 reduces the risk of radiation exposure and/or accident during the conditioning and transfer process. The transfer cask 100 of FIG. 2 comprises a liquid shielding within the interior and exterior side walls of the transfer cask body 103. The liquid shielding, may comprise one or more compartments within the transfer cask body 103 which contains water and/or other type of appropriate liquid for shielding radiation. Since neutrons may be slowed and the chemical bonds broken upon interaction with the hydrogen of the water, the water shields the emitted radiation. In addition to shielding radiation emitted from spent nuclear fuel, the liquid shield may also be used to passively cool the spent nuclear fuel by serving as a conductor and, thus, allowing any heat to escape radially from the transfer cask 100.

Although the neutron shield 203 shown in FIG. 2, is a liquid shield, the transfer cask may comprise solid shielding, such as, for example, a modular shielding system comprising modular fins may be used to shield neutrons and dissipate thermal energy from the cask body. An example of a solid neutron shield is discussed in greater detail in U.S. Pat. No. 7,342,989, issued on Mar. 11, 2008, and entitled "Apparatuses and Methods for Mechanical Shielding and Cooling," which is hereby incorporated by reference in its entirety. The solid shield may extend from the exterior side wall of the transfer cask body 103.

Figure 3:
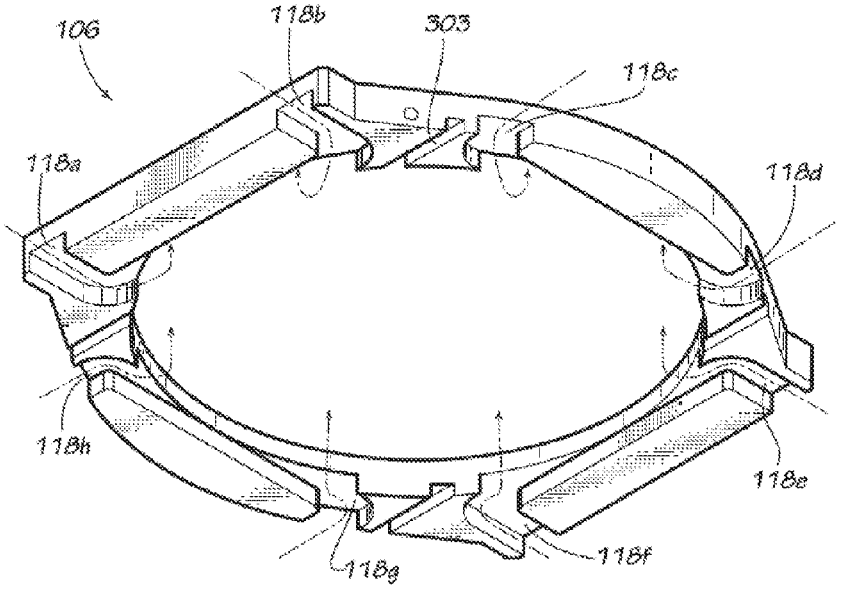
FIG. 3 is a drawing of an example of an inlet ring of the transfer cask of FIG. 1 according to various embodiments of the present disclosure.

Turning now to FIG. 3, shown is a drawing of a non-limiting example of the inlet ring 106 of the transfer cask 100 according to various embodiments. The inlet ring 106 is designed to securely fit around the bottom end of the transfer cask body 103. As such, the top surface of the inlet ring 106 is coupled to the bottom end of the transfer cask body 103. The bottom surface of the inlet ring 106 is comprised with air inlets 118*a*, 118*b*, 118*c*, 118*d*, 118*e*, 118*f*, 118*g*, 118*h* (referred to hereinafter as "118") extending from an exterior surface of the inlet ring 106 to the interior surface of the inlet ring 106. As illustrated by the directional arrows in FIG. 3, air received at the inlet opening at the exterior surface of the inlet ring 106 travels through the inlet ring 106 to the inlet opening at the interior surface of the inlet ring 106. Although the inlet ring 106 of FIG. 3 comprises eight air inlets 118, inlet ring 106 may be configured with additional or fewer air inlets 118 so long as air is still received by the defined annular regions. The inlet ring 106 may further comprise positioning slots 303 which are designed to guide the support rails 119 of the transfer door 109 when opening and closing the transfer door 109. The support rails 119 further support the bottom end of the spent nuclear fuel canister 403 (FIG. 4) when disposed within the transfer cask 100.

Figure 4:
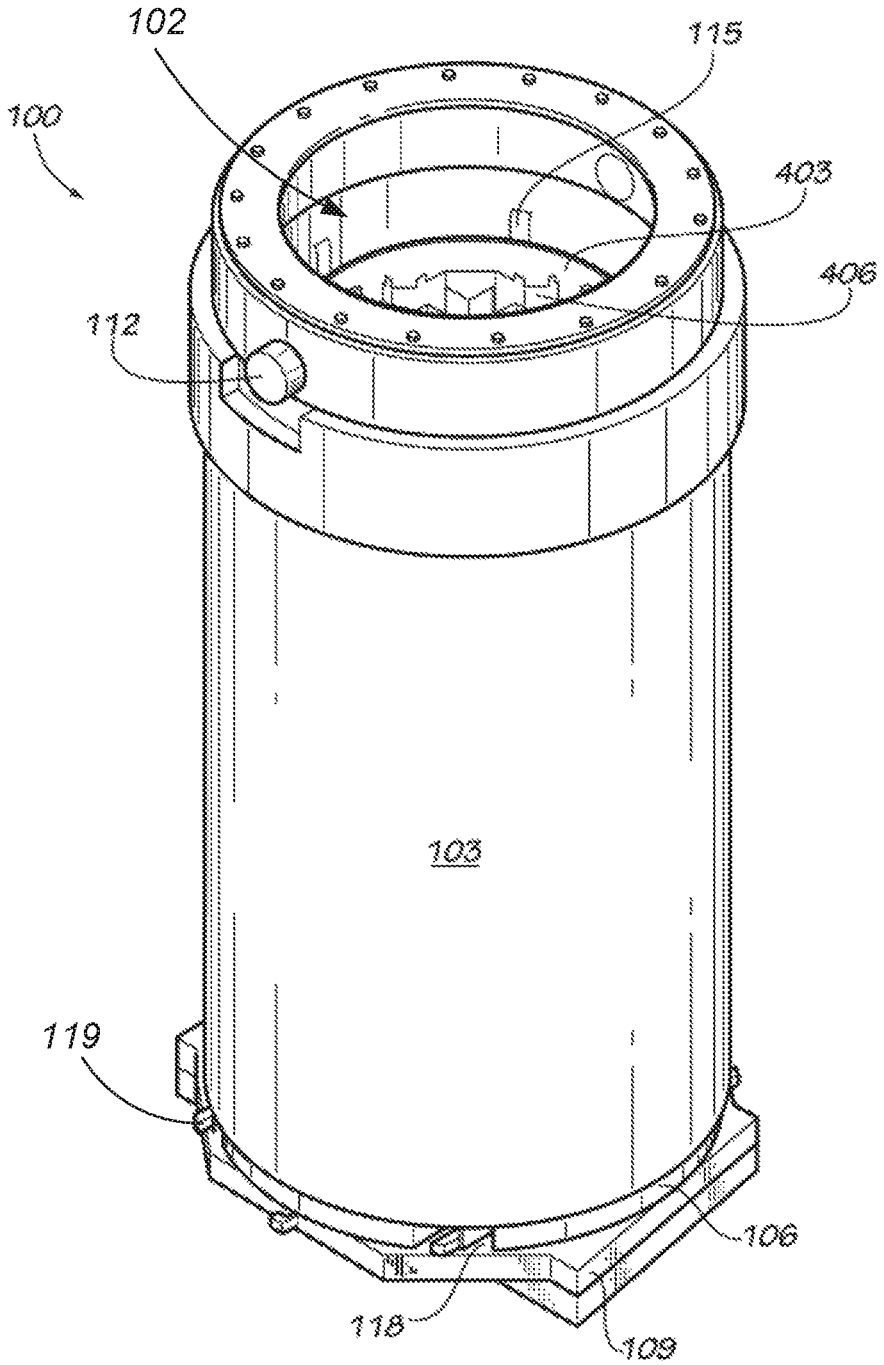
FIG. 4 is a drawing of an example of the transfer cask of FIG. 1 having a spent nuclear fuel canister inserted therein according to various embodiments of the present disclosure.

With reference now to FIG. 4, shown is a drawing of a non-limiting example of the transfer cask 100 including a spent nuclear fuel canister 403 disposed within according to various embodiments. The spent nuclear fuel canister 403 comprises a cylindrical canister body that is configured to be inserted within the transfer cask 100. Disposed within the spent nuclear fuel canister 403 is the spent nuclear fuel that has been deemed suitable for dry storage. The spent nuclear fuel may be within a spent nuclear fuel canister 403 during the wet storage process or may be transferred to the spent nuclear fuel canister 403 at any time prior to the removal from the fuel pool. Although, FIG. 4 illustrates the spent nuclear fuel within a spent nuclear fuel assembly 406, it should be understood that the spent nuclear fuel may be stored within the spent nuclear fuel canister 403 according to other appropriate arrangements.

As previously discussed, the transfer cask 100 may be used to transfer the spent nuclear fuel from wet storage to dry storage. The transfer cask 100 may be submerged into a transfer area of the nuclear fuel pool containing the spent nuclear fuel. The transfer cask 100 is configured to accept the spent nuclear fuel canister 403 having the spent nuclear fuel disposed therein. The spent nuclear fuel canister 403 may also include a closure lid (not shown) which may be placed over the top end of the spent nuclear fuel canister 403 and properly sealed prior to the removal from the fuel pool. The closure lid may be comprised of metal or other suitable material, and may further be equipped with shielding material to shield radiation emitted from the spent nuclear fuel.

Figure 5:
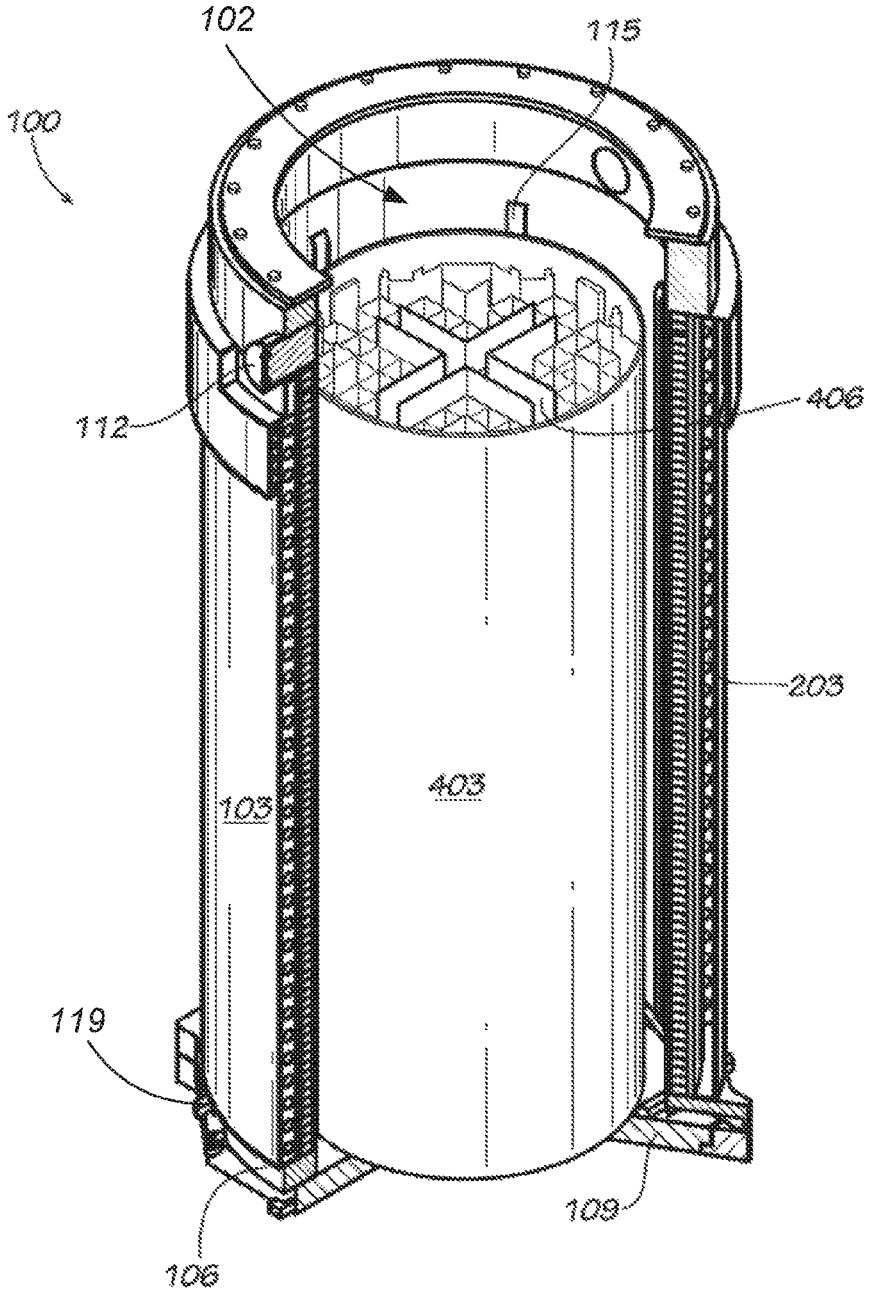
FIG. 5 is a drawing of an example of a cross-sectional view of the transfer cask containing the spent nuclear fuel canister of FIG. 5 according to various embodiments of the present disclosure.

Moving on to FIG. 5, shown is a drawing of a non-limiting example of a cross-section of the transfer cask 100 including the spent nuclear fuel canister 403 disposed within according to various embodiments. As illustrated, the spent nuclear fuel canister 403 is disposed within the transfer cask 100 such that the interior side walls of the transfer cask 100 surround the exterior wall of the spent nuclear fuel canister 403 and the bottom end of the spent nuclear fuel canister 403 rests above the transfer door 109. As a non-limiting example, the spent nuclear fuel canister 403 may rest on the support rails 119 of the transfer door 109. Due in part to the protrusion of the spacing components 115, annular regions may be defined by the spacing components 115, the exterior side wall of the canister 403, and the interior wall of the transfer cask 100. The annular regions create annular air passageways permitting convective air flow such that the air that is received at the inlet openings of the inlet rings will be guided to the annular air passageways and rise over and above the closure lid for discharge at the top end of the transfer cask 100. Heat emitted from the spent nuclear fuel canister 403 will be transferred to the rising air within the annular regions and released at the opening 102 at the top end of the transfer cask 100.

Figure 6:
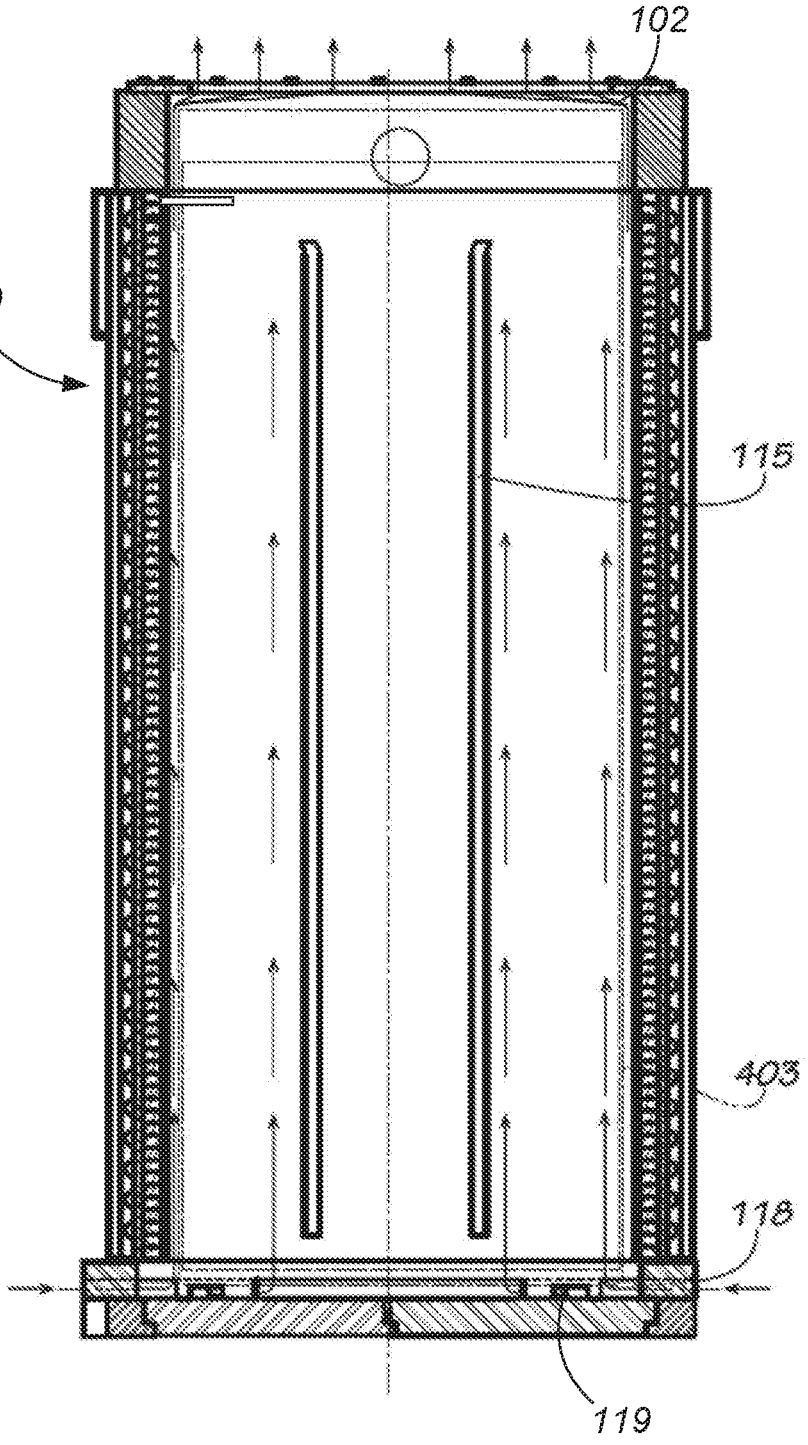
FIG. 6 is a drawing of an example of a cross sectional view of the transfer cask containing the spent nuclear fuel canister of FIG. 4 and taken along line 6-6 of FIG. 1, showing the air flow through the annular air passageways of the transfer cask according to various embodiments of the present disclosure.

Turning now to FIG. 6, shown is a drawing of a non-limiting example of a cross-sectional view of the transfer cask 100 including the spent nuclear fuel canister 403 showing convective air flow according to various embodiments. The cross-section is of the portion of the transfer cask 100 illustrated by reference numeral 6 in FIG. 1. As illustrated, the air enters the air inlets 118 near the lower end of the transfer cask 100. The air will be guided into the annular region defined by the area between the spacing components 115, the exterior sidewall of the spent nuclear fuel canister 403, and the interior sidewall of the transfer cask 100. Once the air enters the annular region, the air rises as the thermal energy emitted from the spent nuclear fuel canister 403 enters the defined annular regions within the interior of the transfer cask 100. The air rises by convection and exits through the opening 102 of the top end of the transfer cask 100 over the sealed spent nuclear fuel canister 403.

Moving on to FIG. 7, shown is a drawing of a non-limiting example of the transfer cask 100 including the spent nuclear fuel canister 403 where the transfer cask 100 is suspended above a transport or storage cask 703 for transfer according to various embodiments of the disclosure. The transfer cask 100 is suspended over the transfer or storage cask 703 by a lifting device 706 which is attached to the lifting components 112 of the transfer cask 100. The transfer door 109 is opened so that the spent nuclear fuel canister 403 may be inserted into the transfer or storage cask 703 which is designed to properly cool the heat and shield the radiation emitted from the spent nuclear fuel canister 403. Due to the design of the transfer cask 100, the air is naturally received at the air inlets 118 (FIGS. 1-6) of the inlet ring 106 (FIGS. 1-6) and guided into the annular regions. The air will rise by convection via the heat emitted from the spent nuclear fuel within the spent nuclear fuel canister 403 and discharge from the opening 102 at the top end of the transfer cask 100.

Figure 8:
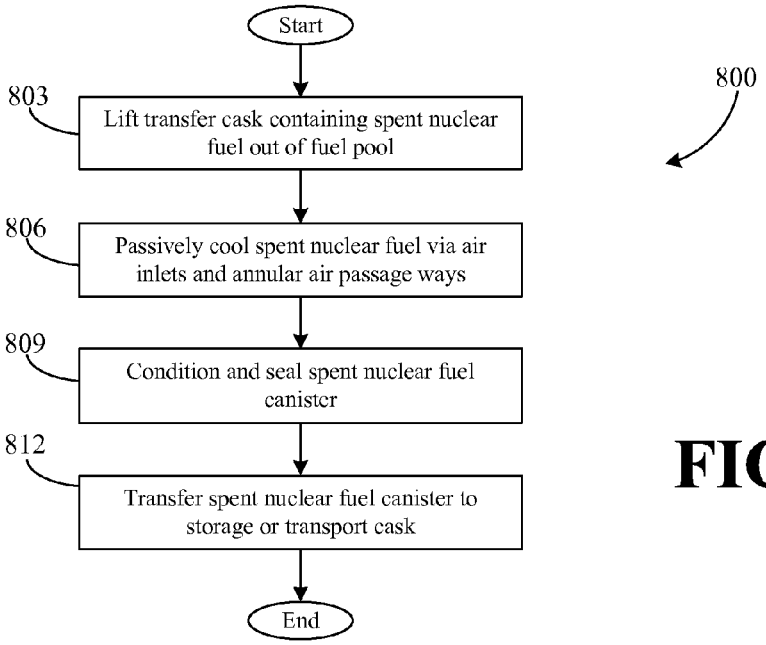
FIGS. 8-9 are flowcharts illustrating methods according to various embodiments of the present disclosure.

With reference to FIG. 8, shown is a flowchart that provides one example of a method 800 of various embodiments of the present disclosure. It is understood that the flowchart of FIG. 8 merely provides examples of the many different types of functional arrangements that may be employed to implement the operation of the methods as described herein.

At reference numeral 803, a transfer cask 100 (FIGS. 1-2 and 4-7) including a spent nuclear fuel canister 403 (FIGS. 4-7) having spent nuclear fuel disposed within is lifted out of the transfer area of the spent nuclear fuel transfer pool. The transfer cask 100 may be lifted out of the spent nuclear fuel pool via a lifting device 706 (FIG. 7) that is attached to the lifting components 112 (FIGS. 1-2, 4-5, and 7) of the transfer cask 100. As the transfer cask 100 is lifted from the nuclear fuel pool, any water from the nuclear fuel pool that is within the interior channel defined by the interior side walls of the transfer cask 100 may naturally drain out of the transfer cask 100 via the annular regions and air inlets 118 (FIGS. 1-6) of the inlet ring 106 (FIGS. 1-6).

At reference numeral 806, the spent nuclear fuel may be passively cooled via the air naturally received at the air inlets 118 on the exterior surface of the inlet ring 106. The air is guided to the interior surface of the inlet ring 106 into the lower end of the annular regions formed by the interior side wall of the transfer cask 100, the exterior side wall of the spent nuclear fuel canister 403, and the spacing components 115 (FIGS. 1-2 and 4-6) protruding from the interior wall of the transfer cask body 103 (FIGS. 1-2 and 4-5). As the air enters the annular regions defined by the spent nuclear fuel canister 403, transfer cask 100, and spacing components 115, the air will rise by convection. The thermal energy/heat emitted from the spent nuclear fuel within the spent nuclear fuel canister 403 will be transferred to the air within the annular regions, thereby passively cooling the spent nuclear fuel.

At reference numeral 809, the fuel canister is conditioned and properly sealed prior to transfer to a transport or storage canister. During the conditioning and sealing process, the transfer cask 100 will continue to passively cool by the air naturally received at the air inlets 118 that rises by convection through the annular regions within the interior of the transfer cask 100, via the heat emitted from the spent nuclear fuel. Since the transfer cask 100 is configured to cool the spent nuclear fuel and shield emitted radiation, the conditioning and sealing process contains a reduced risk of exposure. Additionally, due to the continual air flow which cools the spent nuclear fuel, the spent nuclear fuel may not increase to unsafe temperature ranges requiring the spent nuclear fuel to be returned to the nuclear fuel pool.

At reference numeral 812, the transfer cask 100 is suspended over the transport or storage cask 703 (FIG. 7) for transfer of the spent nuclear fuel canister 403. As the spent nuclear fuel canister 403 is transferred to the transport or storage cask 703, the air will continue to flow and rise by convection within the transfer cask 100 until the spent nuclear fuel canister 403 has been fully inserted into the transport or storage cask 703.

Figure 9:
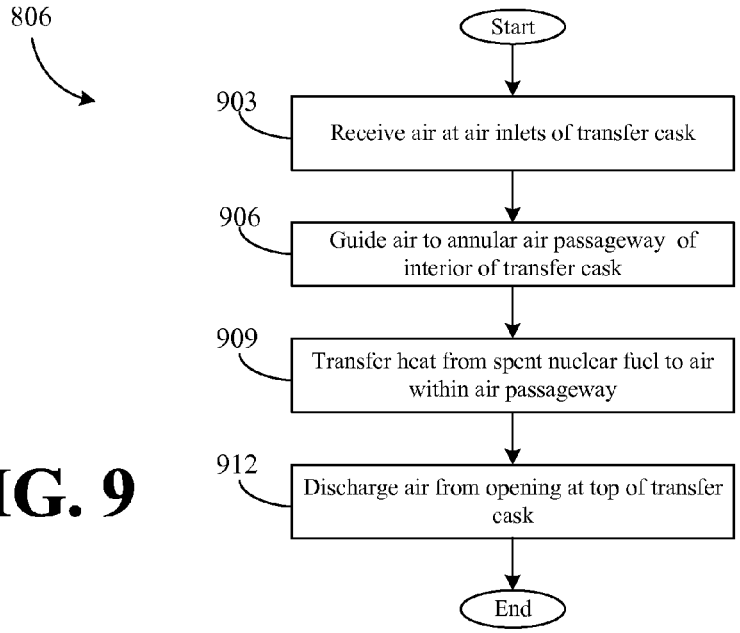

With reference to FIG. 9, shown is a flowchart that provides one example of passively cooling the spent nuclear fuel of various embodiments of the present disclosure. It is understood that the flowchart of FIG. 9 merely provides examples of the many different types of functional arrangements that may be employed to implement the operation of the methods as described herein.

At reference numeral 903, air is naturally received at air inlets 118 (FIGS. 1-6) of a transfer cask 100 (FIGS. 1-2 and 4-7). At 906, as air enters the air inlets 118 at the exterior surface of the inlet ring 106, the air travels, via the air inlets 118 to the interior surface of the inlet ring 106 into the lower end of the annular regions formed by the interior side wall of the transfer cask 100, the exterior side wall of the spent nuclear fuel canister 403 (FIGS. 4-7), and the spacing components 115 (FIGS. 1-2 and 4-6) protruding from the interior wall of the transfer cask body 103 (FIGS. 1-2 and 4-5). At reference numeral 909, as the air enters the annular regions defined by the spent nuclear fuel canister 403, transfer cask 100, and spacing components 115, the air will rise by convection. The thermal energy/heat emitted from the spent nuclear fuel within the spent nuclear fuel canister 403 will be transferred to the air within the annular regions, thereby passively cooling the spent nuclear fuel.

At reference numeral 912, the air is dispersed out of the opening at the top of the transfer cask 100 as the air reaches the top of the spent nuclear fuel canister 403. In some embodiments, the closure lid of the spent nuclear fuel canister 403 may be below the level of the top of the transfer cask 100. As such, the air may exit the defined annular regions and rise over and/or above the closure lid of the spent nuclear fuel canister 403 and out of the opening 102 at the top end of the transfer cask 100.

Although the flowcharts of FIGS. 8 and 9 show a specific order of execution, it is understood that the order of execution may differ from that which is depicted. For example, the order of execution of two or more steps may be scrambled relative to the order shown. Also, two or more steps shown in succession in FIGS. 8 and 9 may be executed concurrently or with partial concurrence. Further, in some embodiments, one or more of the steps shown in FIGS. 8 and 9 may be skipped or omitted.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. A transfer cask system that implements passive cooling, the transfer cask system comprising:

a first cylindrical container having a first side wall that defines a first interior channel extending from a first top to a first closed bottom, the first interior channel containing spent nuclear fuel;

a second cylindrical container having a second side wall that defines a second interior channel extending form a second top to a second bottom end, the second interior channel containing the first cylindrical container, the second side wall being spaced from the first side wall to define an annular air passage, the second cylindrical container having air inlets near the second bottom end and an opening at the second top that permit air to flow from the air inlets, through the annular air passage, and to the opening to thereby remove heat by convection from the first cylindrical container; and a transfer door situated at the second bottom end of the second cylindrical container, the transfer door being configured to open and close, and the transfer door comprising one or more support rails configured to support the first cylindrical container resting on the one or more support rails.

2. The transfer cask system of claim 1, wherein the second cylindrical container comprises a transfer cask, the first cylindrical container comprises a spent nuclear fuel container, and the transfer cask is configured to transfer the spent nuclear fuel container from wet storage to dry storage.

3. The transfer cask system of claim 1, further comprising a plurality of spacing components protruding from the second side wall into the second interior channel, wherein the spacing components generate a gap between the second side wall and the first side wall.

4. The transfer cask system of claim 3, wherein the spacing components extend from about the second bottom end to about the second top.

5. The transfer cask system of claim 1, further comprising a liquid neutron shield situated within the second side wall of the second cylindrical container.

6. The transfer cask system of claim 5, wherein the liquid neutron shield is designed to absorb heat emitted from the first cylindrical container.

7. The transfer cask system of claim 5, wherein the liquid neutron shield is designed to shield radiation generated within the first cylindrical container.

8. The transfer cask of claim 1, wherein individual ones of the air inlets extend from an exterior surface of the second cylindrical container to an interior surface of the second cylindrical container.

9. The transfer cask system of claim 1, wherein the second cylindrical container comprises an inlet ring disposed near the second bottom end of the second cylindrical container, and wherein the inlet ring comprises the air inlets such that the air inlets extend from an exterior surface of the inlet ring to an interior surface of the inlet ring.

10. The transfer cask system of claim 1, wherein the first cylindrical container is removably disposed within the second cylindrical container.

11. The transfer cask system of claim 1, further comprising a neutron shield situated at an exterior of the second side wall of the second cylindrical container.

12. A transfer cask system that implements passive cooling, comprising:

a first elongated cylindrical container having a first annular side wall that defines a first interior extending from a first top to a first closed bottom, the first interior containing spent nuclear fuel;

a second elongated cylindrical container having a second annular side wall that defines a second interior extending from a second top to a second bottom end, the second interior containing the first elongated cylindrical container, the second annular side wall being spaced from the first annular side wall to define an elongated cylindrical annular air passage, and the second elongated cylindrical container having air inlets near the second bottom end and an opening near the second top that permit air to flow from the air inlets, through the elongated cylindrical annular air passage, and to the opening to thereby remove heat by convection from the first elongated cylindrical container;

an annular neutron shield associated with the second annular side wall, the annular neutron shield designed to absorb heat produced by the first elongated cylindrical container; and a transfer door positioned at the second bottom end of the second elongated cylindrical container, the transfer door being configured to open and close, and the transfer door comprising one or more support rails configured to support the first elongated cylindrical container resting on top of the one or more support rails.

13. The transfer cask system of claim 12, wherein the annular neutron shield is a liquid neutron shield.

14. The transfer cask system of claim 12, wherein individual ones of the air inlets extend from an exterior surface of the second elongated cylindrical container to an interior surface of the second elongated cylindrical container.

15. The transfer cask system of claim 12, wherein the second elongated cylindrical container comprises an inlet ring disposed near the second bottom end of the second elongated cylindrical container, and wherein the inlet ring forms the air inlets such that the air inlets extend from an exterior surface of the inlet ring to an interior surface of the inlet ring.

16. The transfer cask system of claim 12, wherein the second elongated cylindrical container comprises a transfer cask and the first elongated cylindrical container comprises a spent nuclear fuel container, and the transfer cask is configured to transfer the spent nuclear fuel container from wet storage to dry storage.

17. The transfer cask system of claim 9, wherein the transfer door is coupled to the inlet ring, and the inlet ring further comprises positioning slots configured to engage with the one or more support rails.

18. The transfer cask system of claim 15, wherein the transfer door is coupled to the inlet ring, and the inlet ring further comprises positioning slots configured to engage with the one or more support rails.

19. The transfer cask system of claim 1, wherein the second cylindrical container comprises one or more lifting components extending outwardly from an upper portion of an exterior of the second cylindrical container.

20. The transfer cask system of claim 12, wherein the second elongated cylindrical container comprises one or more lifting components extending outwardly from an upper portion of an exterior of the second elongated cylindrical container.

* * * * *